US007030840B2

(12) United States Patent
Mametsuka

(10) Patent No.: US 7,030,840 B2
(45) Date of Patent: Apr. 18, 2006

(54) DISPLAY DEVICE HAVING A PLURALITY OF PIXELS HAVING DIFFERENT LUMINOSITY CHARACTERISTICS

(75) Inventor: Koji Mametsuka, Ageo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 255 days.

(21) Appl. No.: 10/358,306

(22) Filed: Feb. 5, 2003

(65) Prior Publication Data

US 2003/0146887 A1 Aug. 7, 2003

(30) Foreign Application Priority Data

Feb. 6, 2002 (JP) ..... 2002-029908

(51) Int. Cl.
*G09G 3/30* (2006.01)

(52) U.S. Cl. ..... 345/76; 345/89; 345/98

(58) Field of Classification Search ..... 345/76–104, 345/204; 315/169.3, 169.1
See application file for complete search history.

(56) References Cited

U.S. PATENT DOCUMENTS 5,617,091 A * 4/1997 Uda ..... 341/154
6,549,182 B1 * 4/2003 Nitta et al. ..... 345/89
6,702,407 B1 * 3/2004 Azami ..... 305/204
2001/0050663 A1 * 12/2001 Park ..... 345/76

FOREIGN PATENT DOCUMENTS

JP 03-203778 A 9/1991
JP 08-054835 A 2/1996
JP 11-009631 A 1/1999

OTHER PUBLICATIONS

Korea Office Action dated Jan. 31, 2005 for Appl. No. 10-2003-0007408.

* cited by examiner

*Primary Examiner*—Regina Liang
(74) *Attorney, Agent, or Firm*—Pillsbury Winthrop Shaw Pittman, LLP

(57) ABSTRACT

A display device comprises pixels PX each of which has one of different luminosity characteristics, signal line blocks each including a preset number of signal lines X connected to the pixels PX having a common one of the luminosity characteristics, and a signal line driving circuit which drives the signal lines X according to a video signal. Particularly, the signal line driving circuit includes a selection circuit which sequentially selects the signal line blocks in an effective picture period of the video signal and an external driving unit which drives the preset number of signal lines included in the signal line block selected by the selection circuit.

5 Claims, 6 Drawing Sheets

DISPLAY DEVICE HAVING A PLURALITY OF PIXELS HAVING DIFFERENT LUMINOSITY CHARACTERISTICS

CROSS-REFERENCE TO RELATED APPLICATIONS

This application is based upon and claims the benefit of priority from the prior Japanese Patent Application No. 2002-029908, filed Feb. 6, 2002, the entire contents of which are incorporated herein by reference.

BACKGROUND OF THE INVENTION

1. Field of the Invention

The present invention relates to a display device having luminous elements arrayed as pixels, and more particularly to a display device in which luminous elements of different luminosity characteristics are used to display a color image.

2. Description of the Related Art

Flat-panel display devices represented by liquid crystal display devices are widely used as monitor displays for a personal computer, a portable information terminal or the like. Recently, display devices that employ luminous elements, such as organic EL (Electro Luminescent) elements arrayed as the pixels attract attention, and active research and development thereof have been carried out.

In the liquid crystal display device, light is transmitted through each pixel and a color filter or the like to display a color image. Thus, transmittance of the pixel is controlled according to the voltage applied thereto. This control differs from that for each luminous element represented by the organic EL element. Luminance of the luminous element is controlled according to the amount of current supplied thereto. Accordingly, each luminous element requires a drive element having a sufficient current driving ability, such as a polysilicon thin film transistor (TFT). Further, it is required that deviations in the characteristics of the drive elements are minimized to display a uniform image. To comply with the requirements, improvements in production and addition of a threshold voltage compensation circuit for each drive element have been suggested.

To obtain a uniform color image, it is further required that the current-luminance characteristics of luminous elements for emitting light, for example, in red (R), green (G) and blue (B) coincide with each other. However, it is difficult to attain coincidence between these characteristics of the luminous elements since the luminous elements of different colors are formed of different materials.

As a technique to solve the problem, it is conceivable that the signal line driving circuit has three reference gradation voltage generating circuits for the luminous colors. These circuits generate groups of reference gradation voltages, which are determined independently for the luminous colors, to compensate for the differences in the current-luminance characteristics. This technique is the same as providing different signal line driving circuits for the luminous colors.

Since this technique increases the size of the display device circuit, low power consumption is not achievable. Further, the display device becomes more expensive due to the increase in the number of circuit components.

BRIEF SUMMARY OF THE INVENTION

The present invention has been made under the circumstances described above. An object of the present invention is to provide a display device in which a complicated circuit configuration is not required in compensating for differences in the luminosity characteristics of pixels, so that a color image can be uniformly displayed without increasing the number of circuit components.

According to the present invention, there is provided a display device which comprises a plurality of pixels each of which has one of different luminosity characteristics, a plurality of signal line blocks each including a preset number of signal lines connected to the pixels having a common one of the luminosity characteristics, and a signal line driving circuit which drives the signal lines according to a video signal, the signal line driving circuit including a selection circuit which sequentially selects the signal line blocks in an effective picture period of the video signal and a driving unit which drives the preset number of signal lines included in the signal line block selected by the selection circuit.

With the display device, the selection circuit sequentially selects the signal line blocks in an effective picture period of the video signal, and the driving unit drives the preset number of signal lines included in the signal line block selected by the selection circuit. Thus, when the driving unit is provided as an external driver IC, the number of wiring lines connected to the external driver IC can be reduced in reverse proportion to the number of signal line blocks. Further, since the driving unit drives the preset number of signal lines connected to the pixels having a common one of the luminosity characteristics, processes of the video signal can be integrated for each luminosity characteristic. For example, when the video signal is converted from a digital form to an analog form from in the driving unit, a group of reference gradation voltages required for conversion can be obtained using a circuit which is configured to divide a reference power supply voltage in a voltage dividing ratio changed for each luminosity characteristic. Accordingly, a complicated circuit configuration is not required to compensate for a difference between the luminosity characteristics of pixels. Thus, a color image can be uniformly displayed without increasing the number of circuit components.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

An organic EL display device according to one embodiment of the present invention will be described with reference to the accompanying drawings.

Figure 1:
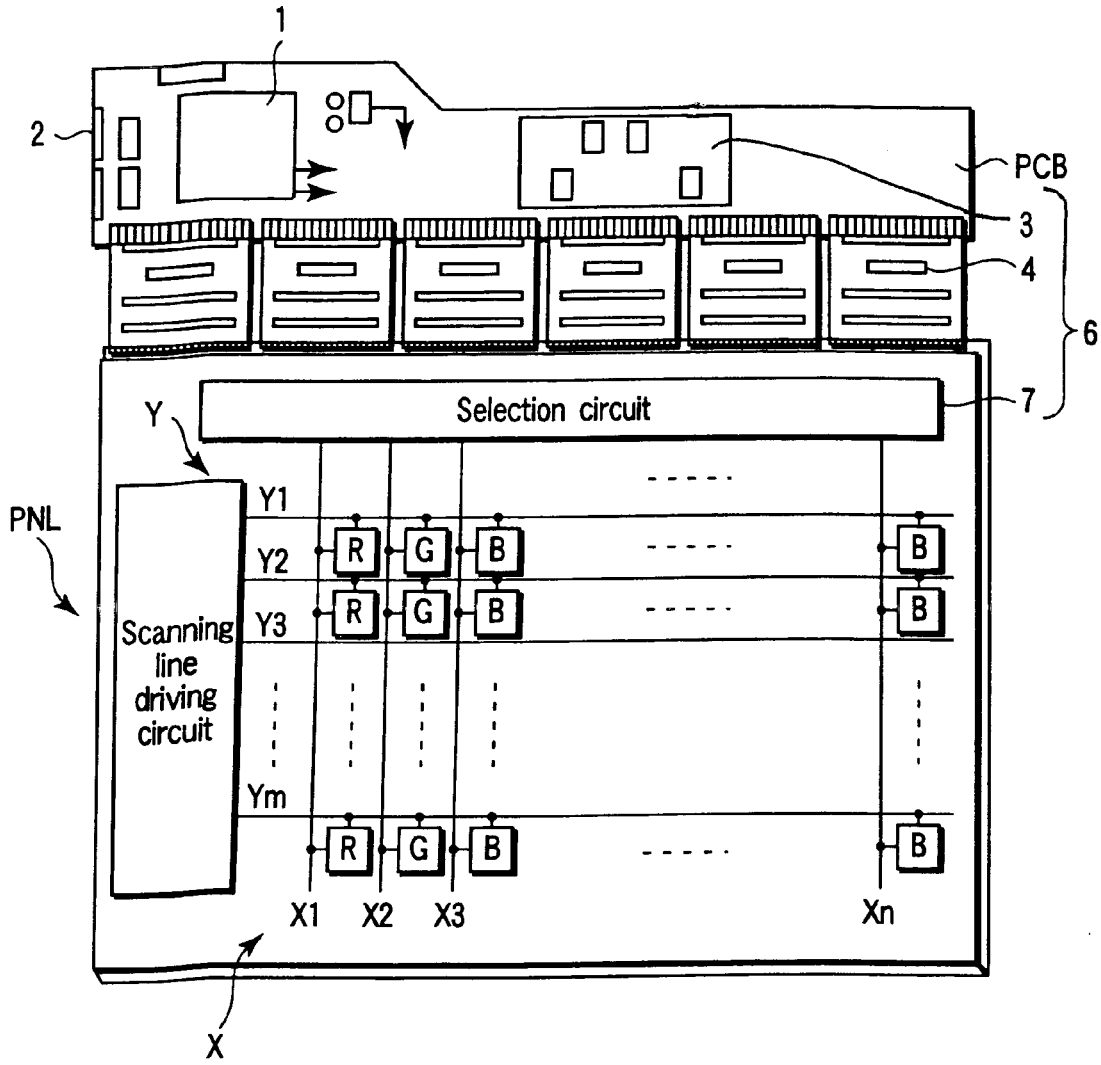
FIG. 1 is a diagram showing the planer structure of an organic EL display device according to one embodiment of the present invention.
Figure 2:
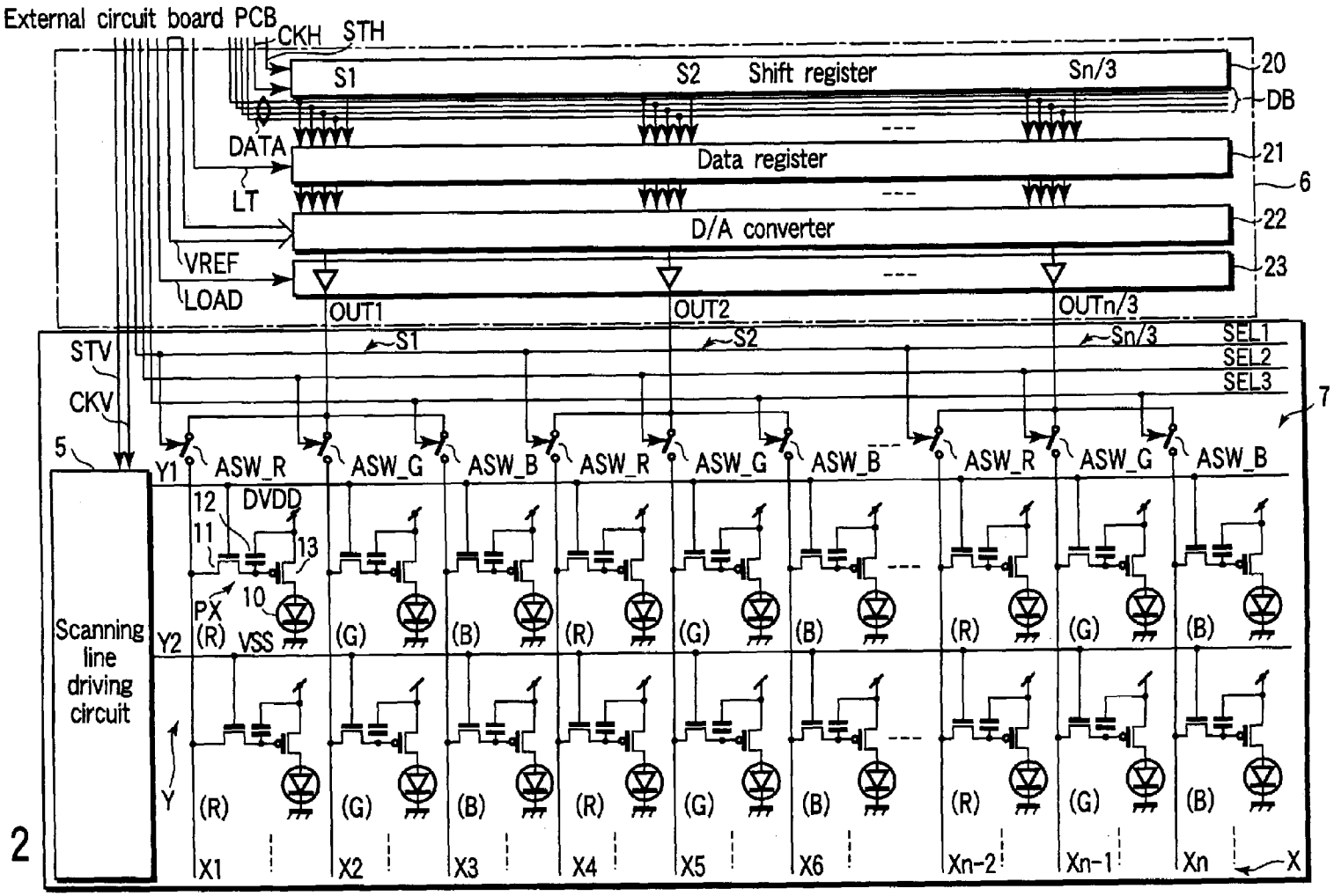
FIG. 2 is a diagram showing the circuit configuration of one part of the organic EL display device shown in FIG. 1 in detail.

FIG. 1 schematically shows the planer structure of the active matrix organic EL display device, and FIG. 2 shows the circuit configuration of one part of the organic EL display device in detail.

This organic EL display device comprises an organic EL display panel PNL and an external circuit board PCB.

The external circuit board PCB includes a control section 1, a DC/DC converter 2, and a reference gradation voltage generating circuit 3. The control section 1 is formed of an IC chip which receives a digital video signal output from a signal source such as a personal computer, generates various control signals to drive the organic EL display panel PNL, and performs a digital process of changing the order of the digital video signal, for example. The DC/DC converter 2 generates different kinds of power supply voltages. The reference gradation voltage generating circuit 3 generates a group of reference gradation voltages VREF using the reference power supply voltage supplied from the DC/DC converter 2. The external circuit board PCB is connected to the organic EL display panel PNK via an external driving unit 4. The external driving unit 4 is formed of a plurality of tape carrier packages TCP each of which has a driver IC mounted on a flexible wiring base.

The organic EL display panel includes a plurality of pixels PX arrayed in a matrix form on a glass plate or the like, m scanning lines Y (Y1 to Ym) disposed along the rows of the pixels PX, n signal lines X (X1 to Xn) disposed along the columns of the pixels PX, a scanning line driving circuit 5 which drives the scanning lines X1 to Xn, and part of a signal line driving circuit 6 which drives the signal lines X1 to Xn.

Three adjacent pixels PX arranged in the row direction form one color pixel, and they emit light of wavelengths corresponding to red (R), green (G) and blue (B) from luminous elements of different luminosity characteristics, respectively.

Each of the pixel PX includes an organic EL element 10 serving as the luminous element, a pixel switch 11 which captures a video signal on a corresponding signal line X under the control from a corresponding scanning line Y, a capacitance element 12 for holding a voltage Vsig of the video signal from the pixel switch 11, and a current-drive element 13 for supplying a drive current to the organic EL element 10 by the control of the video signal voltage Vsig held in the capacitance element 12. The pixel switch 11 is formed, for example, of an N-channel polysilicon thin film transistor, and the current-drive element 13 is formed, for example, of a P-channel polysilicon thin film transistor. The organic EL element 10 is connected in series with the current-drive element 13 between power lines DVDD and DVSS.

More specifically, the organic EL element 10 is connected at a cathode to the power line VSS, and at an anode to a drain of the thin film transistor for the current-drive element 13. This thin film transistor for the current-drive element 13 is connected at a gate to a drain of the thin film transistor for the pixel switch 11, and at a source to the power line DVDD.

The thin film transistor for the pixel switch 11 is connected at a source to the signal line X, and at a gate to the scanning line Y. The capacitance element 12 is formed using the power line DVDD and a wiring line connected between the gate of the thin film transistor for the current-drive element 13 and the drain of the thin film transistor for the pixel switch 11.

The above-mentioned part of the signal line driving circuit 6 serves as a selection circuit 7 which selects one of signal line blocks for red, green, and blue. The signal line block for red includes n/3 signal lines X1, X4, X7, . . . , Xn−2 connected to red pixels PX. The signal line block for green includes n/3 signal lines X2, X5, X8, . . . , Xn−1 connected to green pixels PX. The signal line block for blue includes n/3 signal line X3, X6, X9, . . . , Xn connected to blue pixel PX. The external driving unit 4 drives the n/3 signal lines X included in the signal line block selected by the selection circuit 7, in accordance with the digital video signal from the control section 1. The scanning line driving circuit 5 includes a combination of P- and N-channel polysilicon thin film transistors formed in the same manufacturing process as the thin film transistors in the pixels X.

In the external circuit board PCB, the control section 1 generates a variety of control signals, including a horizontal start signal STH, a horizontal clock signal CKH, a vertical start signal STV, a vertical clock signal CKV, a latch signal LT, a load signal LOAD, block selection signals SEL1 to SEL3, and voltage group selection signals γSEL1 to γSEL3, for example.

The horizontal start signal STH is a pulse generated for each of the signal line blocks in each horizontal scanning period (1H). The horizontal clock signal CKH is a pulse generated for each of the signal lines included in the signal line blocks in each horizontal scanning period. The vertical start signal STV is a pulse generated in each vertical scanning period. The vertical clock signal CKV is a pulse generated for each of the scanning lines in each vertical scanning period. The enable signal ENAB is a signal that is maintained at a high level during the effective picture period included in each horizontal scanning period and serving as a data transfer period, and at a low level during the horizontal blanking period succeeding the data transfer period in the horizontal scanning period. The load signal LOAD is a pulse generated in synchronism with the end of each of the red, green, and blue picture periods, which are obtained by dividing the effective picture period in each horizontal scanning period into three. The block selection signal SEL1 is a signal that is set at a high level only for a preset period corresponding to the maximum transition time of the signal line voltage after the red picture period. The block selection signal SEL2 is a signal that is set at a high level only for a preset period corresponding to the maximum transition time of the signal line voltage after the green picture period. The block selection signal SEL3 is a signal that is set at a high level only for a preset period corresponding to the maximum transition time of the signal line voltage after the blue picture period. The voltage group selection signal γSEL1 is a signal that is synchronized with the block selection signal SEL1. The voltage group selection signal γSEL2 is a signal that is synchronized with the block selection signal SEL2. The voltage group selection signal γSEL3 is the signal that is synchronized with the block selection signal SEL3.

The voltage group selection signals γSEL1 to γSEL3 are supplied from the control section 1 to the reference gradation voltage generating circuit 3. The control signals such as the vertical start signal STV and vertical clock signal CKV, are supplied from the control section 1 to the scanning line driving circuit 5. The digital video signal DATA and the control signals such as the horizontal start signal STH, horizontal clock signal CKH, block selection signals SEL1 to SEL3, enable signal ENAB, and load signal LOAD are supplied from the control section 1 to the signal line driving circuit 6. The reference gradation voltages VREF are supplied from the reference gradation voltage generating circuit 3 to the signal line driving circuit 6.

The scanning line driving circuit 5 sequentially selects the m scanning lines Y by shifting the vertical start signal STV in synchronism with the vertical clock signal CKV, and supplies a gate driving voltage to a selected scanning line Y during the effective picture period included in each horizontal scanning period. The signal line driving circuit 6 sequentially selects the signal lines X included in each signal line block by shifting the horizontal start signal STH in synchronism with the horizontal clock signal CKH, and drives a selected signal line X based on the video signal DATA supplied for the selected signal line X.

The external driving unit 4 includes a data bus DB, shift register 20, data register 21, D/A (Digital-to-Analog) converter 22 and output buffer circuit 23 as shown in FIG. 2. The shift register 20 shifts the horizontal start signal STH in synchronism with the horizontal clock signal CKH. The data bus DB receives the digital video signal DATA from the control section 1. The data register 21 sequentially latches the digital video signal DATA on the data bus DB under the control of the shift register 20 after the enable signal ENAB has been raised. The D/A converter 22 is formed, for example, as resistor DAC modules, each of which outputs an analog video signal corresponding to the digital video signal DATA input thereto by selecting and resistively dividing one of the reference gradation voltages VREF from the reference gradation voltage generating circuit 3. The output buffer circuit 23 receives the analog video signals from the D/A converter 23, and outputs these video signals from output terminals OUT1, OUT2, OUT3, . . . , OUTn/3 to the selection circuit 7 on the organic EL display panel PNL, upon rise of the load signal.

Figure 3:
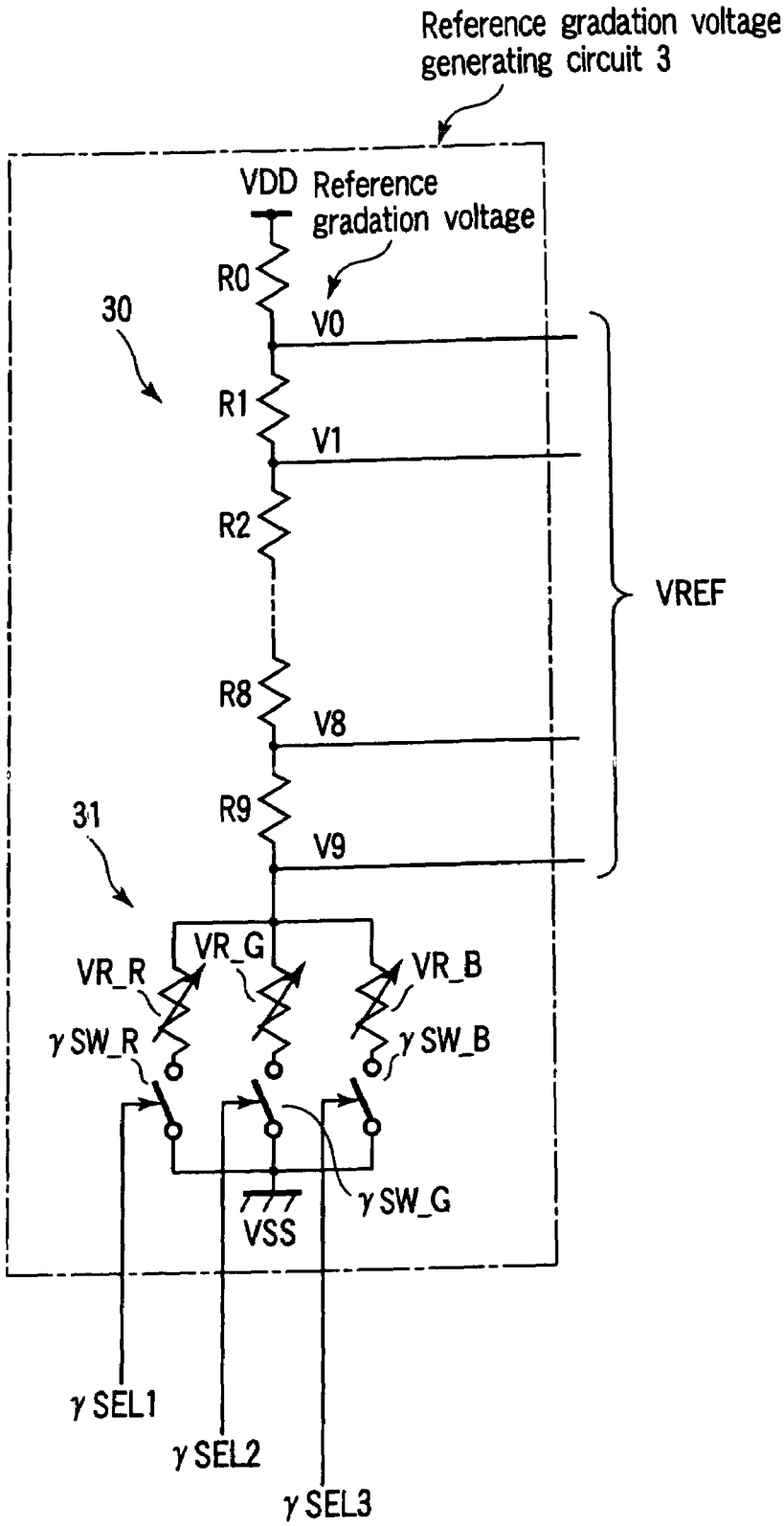
FIG. 3 is a diagram showing the circuit configuration of a reference gradation voltage generating circuit shown in FIG. 1.

As shown in FIG. 3, the reference gradation voltage generating circuit 3 includes a ladder resistor 30 and a voltage dividing ration controller 31 connected in series with the ladder resistor 30 between power lines VDD and VSS that receive a reference power supply voltage. The ladder resistor 30 includes resistors R0 to R9 connected in series, for example. The voltage dividing ratio controller 31 includes three variable resistors VR-R, VR_G and VR_B assigned to the luminous colors for this embodiment, and three switching elements γSW_R, γSW_G and γSW_B. The variable resistor VR_R and the switching element γSW_R serve as a series circuit which determines a voltage dividing ratio for red. The variable resistor VR_G and the switching element γSW_G serve as a series circuit which determines a voltage dividing ratio for green. The variable resistor VR_B and the switching element γSW_B serve as a series circuit which determines a voltage dividing ratio for red. These switching elements γSW_R, γSW_G and γSW_B are controlled by the voltage group selection signals γ SEL1, γ SEL2 and γ SEL3, respectively. Mechanical or electrical potentiometers may be used as the variable resistors VR_R, VR_G and VR_B.

The selection circuit 7 comprises n/3 switch sections S1, S2, S3, . . . , Sn/3 which respectively receive the video signals from the output terminals OUT1, OUT2, . . . , OUTn/3 in each of the red, green and blue picture periods, which are obtained by dividing the effective picture period included in each horizontal scanning period into three. The switch sections S1, S2, S3, . . . , Sn/3 respectively supply the video signals from the output terminals OUT1, OUT2, . . . , OUTn/3 to the three adjacent signal lines X1, X2 and X3; X4, X5 and X6; . . . ; and Xn−2, Xn−1 and Xn. Each of the switch sections S1, S2, S3, . . . , Sn/3 includes switching elements ASW_R, ASW_G and ASW_B respectively controlled by the block selection signals SEL1, SEL2 and SEL3. The switching elements ASW_R, ASW_G and ASW_B of the switch section S1 are connected between the output terminal OUT1 and the respective signal lines X1, X2 and X3, the switching elements ASW_R, ASW_G and ASW_B of the switch section S2 are connected between the output terminal OUT2 and the respective signal lines X4, X5 and X6, the switching elements ASW_R, ASW_G and ASW_B of the switch section S3 are connected between the output terminal OUT3 and the respective signal lines X7, X8 and X9, . . . , and the switching elements ASW_R, ASW_G and ASW_B of the switch section Sn/3 are connected between the output terminal OUTn/3 and the respective signal lines Xn−2, Xn−1 and Xn.

Each of the switching elements ASW_R, ASW_G and ASW_B is formed, for example, of an N-channel polysilicon thin film transistor. The n/3 signal lines X1, X4, X7, . . . , Xn−2 are respectively assigned to the first switching elements ASW_R of the switch sections S1, S2, S3, . . . , Sn/3 as the signal line block for red. The n/3 signal lines X2, X5, X8, . . . , Xn−1 are respectively assigned to the second switching elements ASW_G of the switch sections S1, S2, S3, . . . , Sn/3 as the signal line block for green. The n/3 signal lines X3, X6, X9, . . . , Xn are respectively assigned to the third switching elements ASW_B of the switch sections S1, S2, S3, . . . , Sn/3 as the signal line block for blue.

Figure 4:
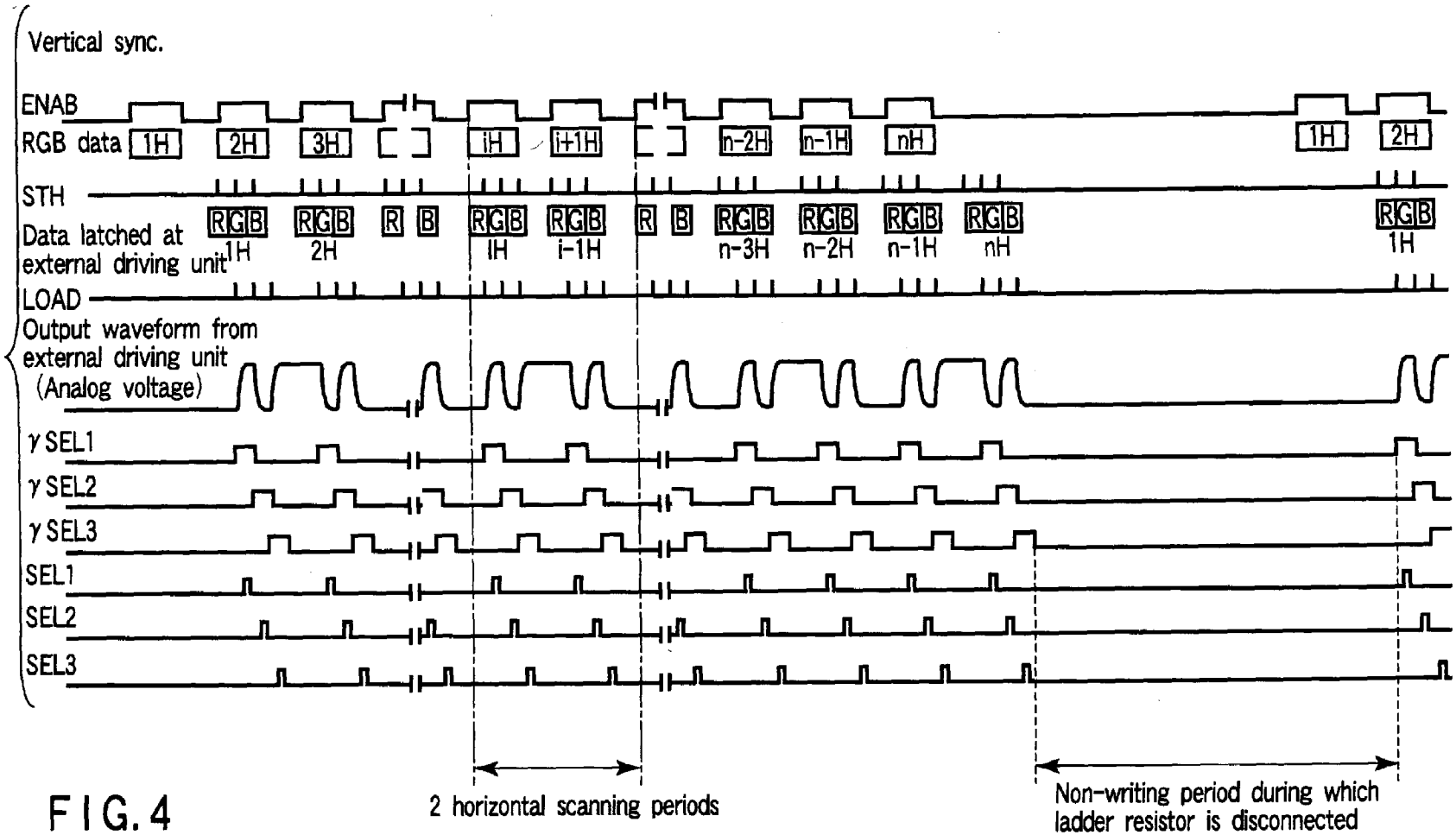
FIG. 4 is a timing chart showing an operation for one vertical scanning period of the organic EL display device shown in FIG. 1.
Figure 5:
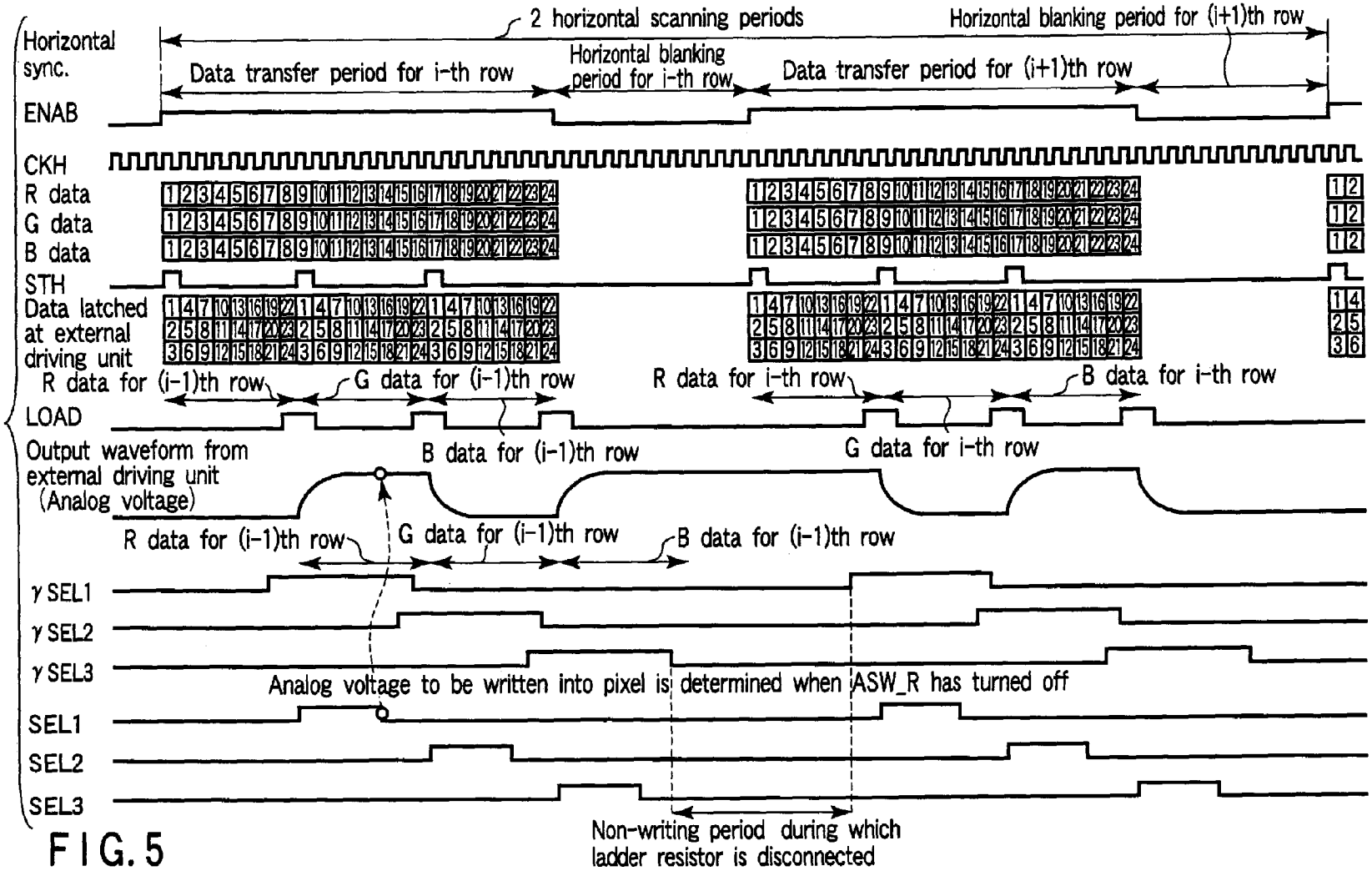
FIG. 5 is a timing chart showing an operation for a 2 horizontal scanning period of the organic EL display device shown in FIG. 1.

FIGS. 4 and 5 show operations of this organic EL display device. For example, when the block selection signal SEL1 is set at a high level and the switching elements ASW_R of the switch sections S1, S2, S3, . . . , Sn/3 are turned on, the video signals from the output terminal OUT1, OUT2, . . . , OUTn/3 are supplied to the signal lines X1, X4, X7, . . . , Xn−2 of the red signal line block during the red picture period. When the block selection signal SEL2 is set at a high level in place of the block selection signal SEL1 and the switching elements ASW_G of the switch sections S1, S2, S3, . . . , Sn/3 are turned on, the video signals from the output terminal OUT1, OUT2, . . . , OUTn/3 are supplied to the signal lines X2, X5, X8, . . . , Xn−1 of the green signal line block during the green picture period. When the block selection signal SEL3 is set at a high level in place of the block selection signal SEL2 and the switching elements ASW_B of the switch sections S1, S2, S3, . . . , Sn/3 are turned on, the video signals from the output terminal OUT1, OUT2, . . . , OUTn/3 are supplied to the signal lines X3, X6, X9, . . . , Xn of the blue signal line block during the blue picture period.

In the voltage dividing ratio controller 31 of the reference gradation voltage generating circuit 3, the voltage group selection signals γSEL1, γSEL2 and γSEL3 perform a control of selectively turning on the switching elements γSW_R, γSW_G and γSW_B in synchronism with a changeover between the switching elements ASW_R, ASW_G and ASW_B of the switch sections S1, S2, S3, . . . , Sn/3, and also a control of turning off all the switching elements γSW_R, γSW_G and γSW_B to prevent current from flowing through the ladder resistor 30 during the non-writing period caused by the non-effective picture period such as the horizontal blanking period and the vertical blanking period.

More specifically, the switching elements ASW_R, ASW_G and ASW_B and the switching elements γSW_R, γSW_G and γSW_B are associated in the following manner. The switching elements ASW_R turn on after the switching element γSW_R has turned on, the switching elements ASW_G turn on after the switching element γSW_G has turned on, and the switching elements ASW_B turn on after the switching element γSW_B has turned on. The switching element γSW_R turns off after the switching elements ASW_R have turned off, the switching element γSW_G turns off after the switching elements ASW_G have turned off, and the switching element γSW_B turns off after the switching elements ASW_B have turned off. Further, the switching element γSW_G turns on after the switching elements ASW_R have turned off, the switching element γSW_B turns on after the switching elements ASW_G have turned off, and the switching element γSW_R turns on after the switching elements ASW_B have turned off. Moreover, the switching elements ASW_G turn on after the switching element γSW_R has turned off, the switching elements ASW_B turn on after the switching element γSW_G has turned off, and the switching elements ASW_R turn on after the switching element γSW_B has turned off. In the voltage dividing ratio controller 31, the switching element γSW_G turns on before the switching element γSW_R has turned off, and the switching element γSW_B turns on before the switching element γSW_G has turned off.

Figure 6:
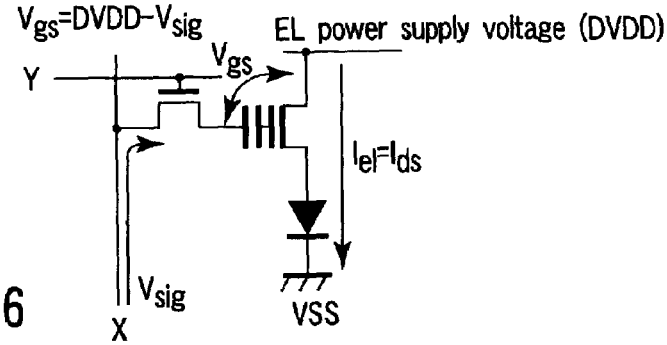
FIG. 6 is a diagram showing the basic configuration of a pixel shown in FIG. 2.

The driving manner of each pixel PX will be described next. FIG. 6 shows the basic configuration of the pixel PX. The video signal voltage Vsig is required for setting the organic EL element 10 at a desired luminance and is supplied from the external driving unit 4 to the switching elements ASW_R, ASW_G and ASW_B.

While the scanning signal from the scanning line Y is maintained at a high level, the N-channel thin film transistor for the pixel switch 11 is in an active state where the video signal voltage Vsig on the signal line X is applied to the electrode on one side of the capacitance element 12, to charge the capacitance element 12. The potential held by the one-side electrode of the capacitance element 12 is finally determined by the video signal voltage Vsig obtained on the signal line X when the scanning signal from the scanning line has been changed to a low level. The one-side electrode of the capacitance element 12 is connected to the gate of the P-channel thin film transistor for the current-drive element 13, and the electrode on the other side of the capacitance element 12 is connected to the source of this P-channel thin film transistor. Thus, the charged voltage across the capacitance element 12 serves as the gate-source voltage Vgs of the P-channel thin film transistor.

Figure 7:
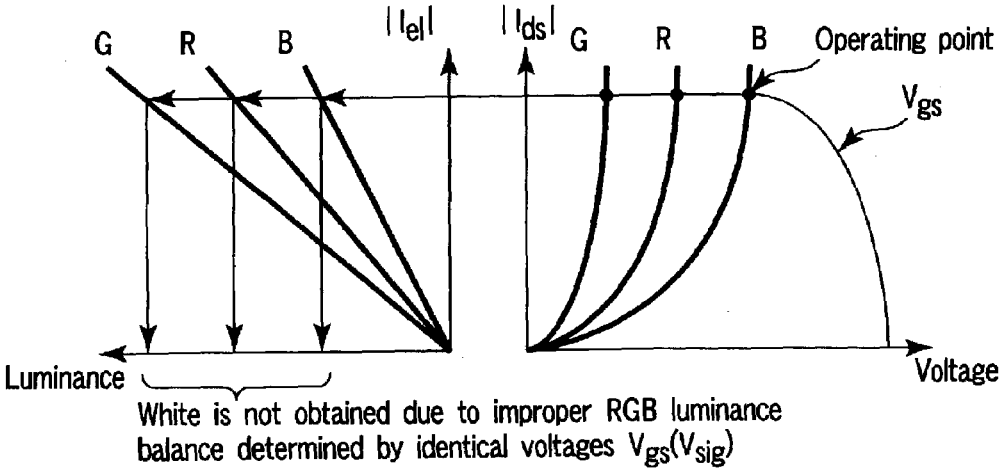
FIG. 7 is a graph showing an RGB luminosity relationship obtained when the voltage dividing ratio is fixed in the reference gradation voltage generating circuit shown in FIG. 3.

FIG. 7 shows an RGB luminosity relationship when the voltage dividing ratio is fixed in reference gradation voltage generating circuit 3. In the state where the voltage of the power line DVDD is 5V, the operation point shown in FIG. 6 is derived from the characteristic of the drain-source voltage Vds to the drain between drain-source current Ids of the P channel type thin film transistor with the gate-source voltage Vgs used as a parameter.

The current Ids increases and decreases in accordance with the voltage Vgs. Since the current Ids equals the current Iel flowing in the organic EL element 10, the current Iel varies with the video signal voltage Vsig to determine the luminance of the organic EL element 10. However, if identical reference gradation voltages are output for the RGB video signals in each gradation from the reference gradation voltage generating circuit 3, an excellent white balance cannot be attained since the RGB luminosity relationship is not controlled between the red, green and blue organic EL elements 10 whose luminous materials differ in luminous efficiency.

Figure 8:
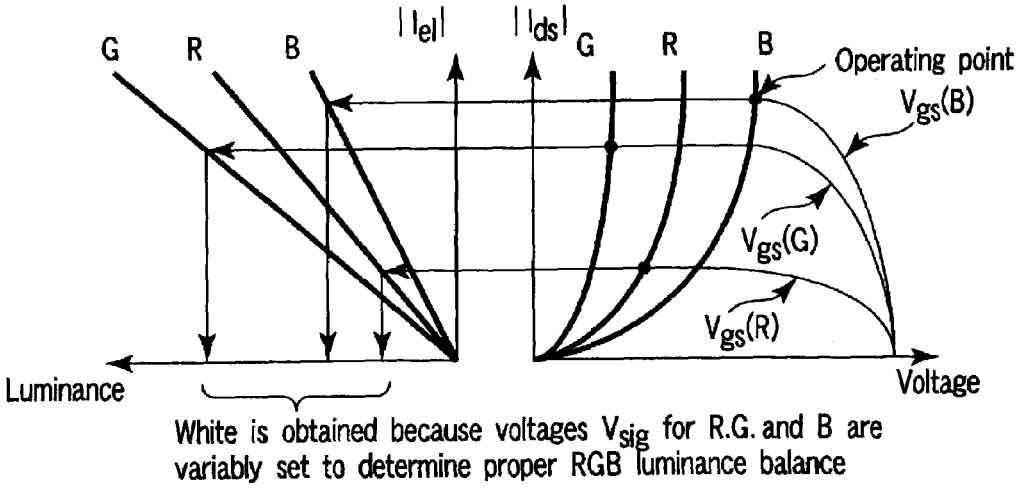
FIG. 8 is a graph showing an RGB luminosity relationship obtained when the voltage dividing ratio is changeable in the reference gradation voltage generating circuit shown in FIG. 3.

FIG. 8 shows an RGB luminosity relationship obtained when the voltage dividing ratio is changeable in the reference gradation voltage generating circuit 3. In the case where the voltage dividing ratio is changed for each luminous color by the voltage dividing ratio controller 31, individual reference gradation voltages are output for the RGB video signals in each gradation from the reference gradation voltage generating circuit 3. Thus, an excellent white balance can be attained since the RGB luminosity relationship is controlled between the red, green and blue organic EL elements 10 whose luminous materials differ in luminous efficiency.

With the display device of the present embodiment, the selection circuit 7 sequentially selects the signal line blocks in an effective picture period of the video signal, and the external driving unit 4 drives the preset number of signal lines X included in the signal line block selected by the selection circuit 7. Thus, when the driving unit 4 is provided as an external driver IC, the number of wiring lines connected to the external driver IC can be reduced in reverse proportion to the number of signal line blocks. Further, since the external driving unit 4 drives the preset number of signal lines X connected to the pixels PX having a common one of the luminosity characteristics, processes of the video signal can be integrated for each luminosity characteristic. For example, when the video signal is converted from a digital form to an analog form in the external driving unit 4, a group of reference gradation voltages required for conversion can be obtained using the reference gradation voltage generating circuit 3 which configured to divide a reference power supply voltage in a voltage dividing ratio changed for each luminosity characteristic. Accordingly, a complicated circuit configuration is not required to compensate for a difference between the luminosity characteristics of pixels PX. Thus, a color image can be uniformly displayed without increasing the number of circuit components.

In addition, all the switching elements γSW_R, γSW_G and γSW_B turn off to shut off a current flowing through the ladder resistor 30 during the non-writing period caused by the non-effective picture period, such as the horizontal blanking period and the vertical blanking period. When 1 horizontal scanning period 70 μsec, 1 horizontal blanking period=10 μsec, 1 vertical scanning period=230 horizontal scanning periods, and 1 vertical blanking period=10 horizontal scanning periods, power consumption can be reduced by about 18%.

In the embodiment described above, the reference gradation voltage generating circuit 3 is placed on the external circuit board PCB. This generating circuit 3 may be displaced onto the external driving unit 4.

In addition, in voltage dividing ratio controller 31 of the embodiment, the switching elements γSW_G and γSW_B turn on before the switching elements γSW_R and γSW_G have turned off, respectively. However, this configuration may be modified into any of the two following configurations. In the first configuration, the switching elements γSW_G and γSW_B turn on after the switching elements γSW_R and γSW_G have turned off, respectively. In the second configuration, the switching elements γSW_G and γSW_B turn on at the time the switching elements γSW_R and γSW_G turn off, respectively.

Further, in the embodiment, the current flowing through the ladder resistor 30 is shut off by turning off all the switching elements γSW_R, γSW_G and γSW_B. Instead, another switching element for shutting off the current flowing through the ladder resistor 30 may be provided in addition to the switching elements γSW_R, γSW_G and γSW_B. This switching element is connected in series with the ladder resistor 30 and controlled to turn off during the non-writing period caused by each non-effective picture period.

Further, the external driving unit 4 may comprise at least one of a circuit equivalent to the variable resistors VR_R, VR_G and a circuit equivalent to the switching elements γSW_R, γSW_G and γSW_B.

Moreover, the present invention is applicable to a signal line driving circuit of a block-at-a-time driving type in which a shift register, analog switches and changeover switches for the signal lines are associated with each other. In addition, a line-at-a-time driver IC for an amorphous silicon thin film transistor based liquid crystal display panel, or a block-at-a-time driver IC for a polysilicon thin film transistor based liquid crystal display panel may be used as the driver IC for the external driving unit 4.

In the embodiment, the luminous elements of a common luminous color are arranged along each signal line. However, luminous elements 10 of a different luminous color may be arranged along each signal line X. In this case, the switch sections S1, S2, S3, . . . , Sn/3 are controlled in synchronism with the switching elements γSW_R, γSW_G and γSW_B such that the outputs of the external driving unit 4 are connected to the luminous elements 10 of proper luminous colors.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display device comprising:

a plurality of pixels each of which has one of different luminosity characteristics;

a plurality of signal line blocks each including a preset number of signal lines connected to said pixels having a common one of the luminosity characteristics; and a signal line driving circuit which drives said signal lines according to a video signal, said signal line driving circuit including a selection circuit which sequentially selects the signal line blocks in an effective picture period of the video signal and a driving unit which drives the preset number of signal lines included in the signal line block selected by the selection circuit, wherein said signal line driving circuit further includes a reference gradation voltage generating circuit which divides a reference power supply voltage at a voltage dividing ratio changed for the signal line block selected by said selection circuit to generate a group of reference gradation voltages, said driving unit includes a data bus which receives the video signal in a digital form, a data register which sequentially latches the video signal on the data bus during an effective picture period of the video signal, and a digital-to-analog converting circuit which converts the video signal output in parallel from said data register into analog voltages with reference to the group of reference gradation voltages generated by said reference gradation voltage generating circuit, said selection circuit includes a preset number of switch sections which electrically connect a preset number of signal lines included in each signal line block to a preset number of output terminals provided in said driving unit, and said reference gradation voltage generating circuit includes a ladder resistor, and a voltage dividing ratio controller connected in series with said ladder resistor between a pair of power terminals which receive the reference power voltage, said voltage dividing ratio controller having a plurality of variable resistors each corresponding to one of the different luminosity characteristics, a plurality of switching elements respectively connected in series with said variable resistors and controlled to synchronize with a changeover between said switch sections.

2. A display device according to claim 1, wherein each of said switch sections includes first, second and third switching elements connected between a common one of the output terminals of said driving unit and adjacent three of the signal lines, respectively.

3. A display device according to claim 2, wherein each of said first, second and third switching elements comprises a thin film transistor.

4. A display device according to claim 1, wherein said pixels, said signal lines, and said selection circuit is disposed on a panel, and said driving unit are disposed on a tape carrier package connected to the panel.

5. A display device according to claim 1, wherein the switching elements in said voltage dividing ratio controller are controlled to shut off a current during a non-writing period caused by a non-effective picture period of the video signal.

* * * * *